US005581825A

United States Patent [19]

Honsvald

[11] Patent Number: 5,581,825

[45] Date of Patent: Dec. 10, 1996

[54] BIDET SHOWER SEAT

[76] Inventor: Magnhild Honsvald, 133 Morris Turnpike, Randolph Township, Morris County, N.J. 07869

[21] Appl. No.: 456,675

[22] Filed: Jun. 1, 1995

[51] Int. Cl.[6] ..... E03D 9/08

[52] U.S. Cl. ..... 4/444; 4/446; 4/447; 4/605

[58] Field of Search ..... 4/443, 444, 446, 4/447, 567, 568, 579, 605, 611

[56] References Cited

U.S. PATENT DOCUMENTS

| | | | |
|---|---|---|---|
| 2,427,953 | 9/1947 | Fishko | 4/444 X |
| 2,520,946 | 9/1950 | Martin | 4/446 |
| 3,805,822 | 4/1974 | Joannon | 4/605 X |

FOREIGN PATENT DOCUMENTS

| | | | |
|---|---|---|---|
| 2344260 | 11/1977 | France | 4/446 |
| 2542192 | 9/1984 | France | 4/444 |
| 2253168 | 5/1974 | Germany | 4/443 |
| 3428447 | 2/1985 | Germany | 4/447 |
| 1739837 | 6/1992 | U.S.S.R. | 4/444 |

*Primary Examiner*—Robert M. Fetsuga

[57] ABSTRACT

A seat for washing portions of a human body. The device includes a stool upon which an individual can sit. An interior bowl of the stool includes spray nozzles directing water onto a genital region of the user. An extendable spray nozzle is mounted to the stool and can be used to selectively shower individual portions of the user. A support chair can be positioned over the stool for further supporting the user relative to the stool during a bathing procedure.

1 Claim, 4 Drawing Sheets

FIG 1
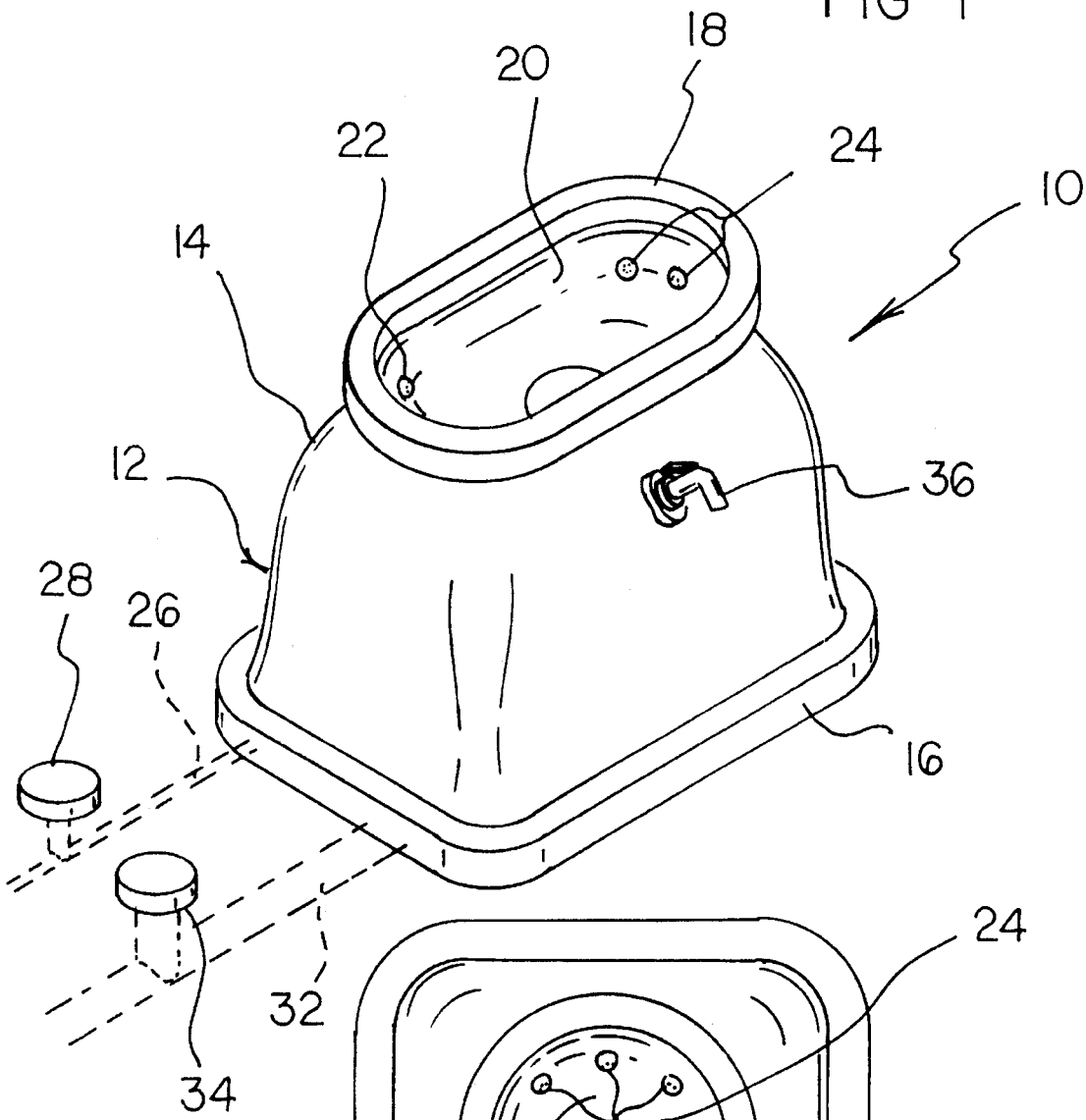
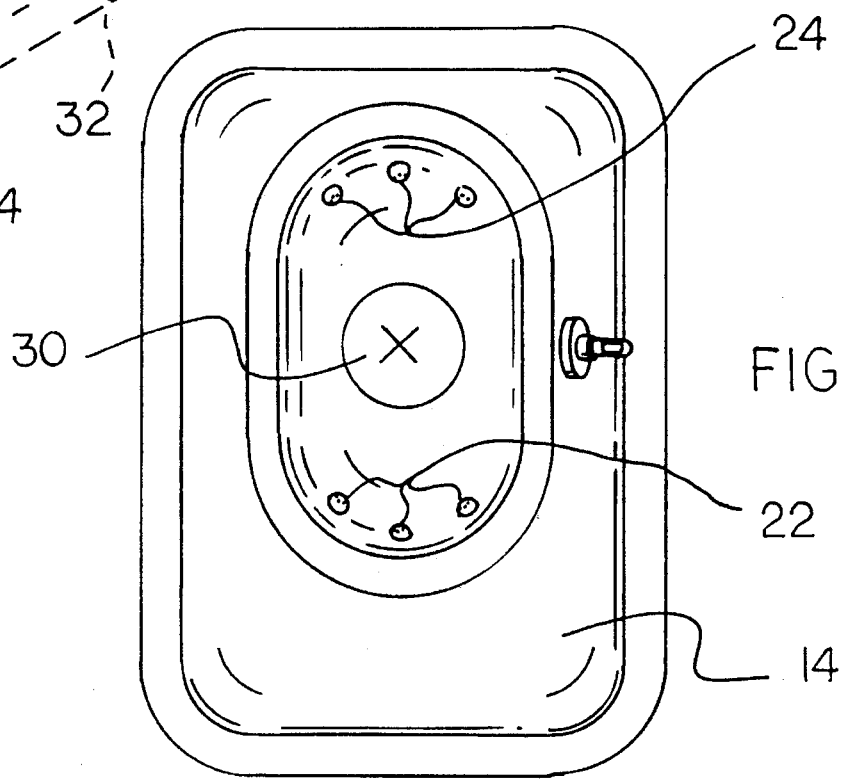
FIG 2

FIG 7
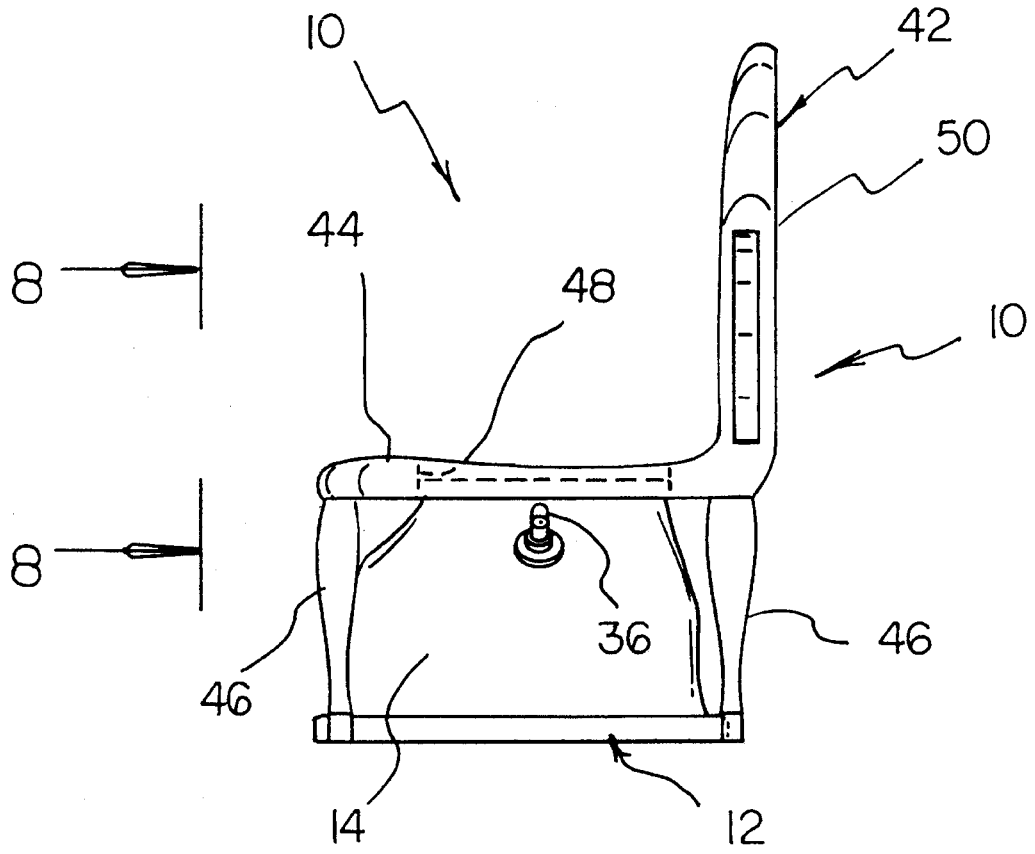
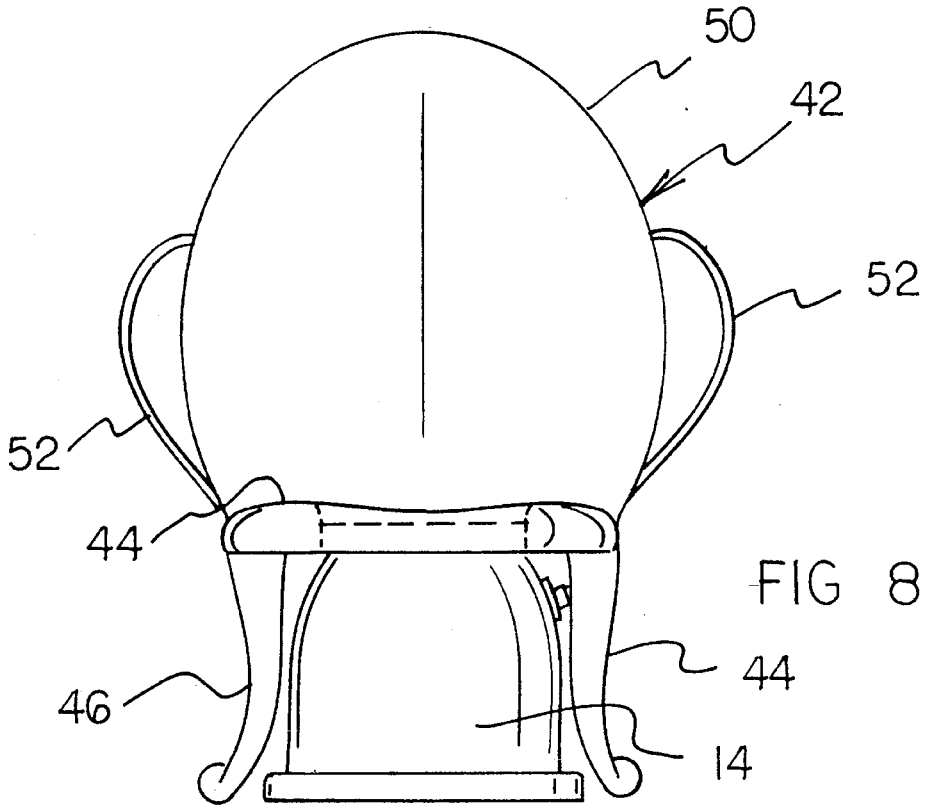
FIG 8

BIDET SHOWER SEAT

BACKGROUND OF THE INVENTION

1. Field of the Invention

The present invention relates to bathing devices and more particularly pertains to a bidet shower seat for washing portions of a human body.

2. Description of the Prior Art

The use of bathing devices is known in the prior art. More specifically, bathing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bathing devices include U.S. Pat. No. 4,841,582; U.S. Pat. No. 4,145,767; U.S. Pat. No. 4,764,997; U.S. Pat. No. 4,550,454; U.S. Pat. No. 4,207,628; and U.S. Pat. No. 5,331,692.

While these devices fulfill their respective, particular objectives and requirements, the aforementioned patents do not disclose a bidet shower seat for washing portions of a human body which includes a stool upon which an individual can sit, with an interior bowl of the stool including spray nozzles directing water onto a genital region of the user, an extendable spray nozzle mounted to the stool which can be used to selectively shower individual portions of the user, and a support chair positioned over the stool for further supporting the user relative to the stool during a bathing procedure.

In these respects, the bidet shower seat according to the present invention substantially departs from the conventional concepts and designs of the prior art, and in so doing provides an apparatus primarily developed for the purpose of washing individual portions of a human body.

SUMMARY OF THE INVENTION

In view of the foregoing disadvantages inherent in the known types of bathing devices now present in the prior art, the present invention provides a new bidet shower seat construction wherein the same can be utilized for washing portions of a human body. As such, the general purpose of the present invention, which will be described subsequently in greater detail, is to provide a new bidet shower seat apparatus and method which has many of the advantages of the bathing devices mentioned heretofore and many novel features that result in a bidet shower seat which is not anticipated, rendered obvious, suggested, or even implied by any of the prior art bathing devices, either alone or in any combination thereof.

To attain this, the present invention generally comprises a seat for washing portions of a human body. The inventive device includes a stool upon which an individual can sit. An interior bowl of the stool includes spray nozzles directing water onto a genital region of the user. An extendable spray nozzle is mounted to the stool and can be used to selectively shower individual portions of the user. A support chair can be positioned over the stool for further supporting the user relative to the stool during a bathing procedure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bidet shower seat apparatus and method which has many of the advantages of the bathing devices mentioned heretofore and many novel features that result in a bidet shower seat which is not anticipated, rendered obvious, suggested, or even implied by any of the prior art tool guides, either alone or in any combination thereof.

It is another object of the present invention to provide a new bidet shower seat which may be easily and efficiently manufactured and marketed.

It is a further object of the present invention to provide a new bidet shower seat which is of a durable and reliable construction.

An even further object of the present invention is to provide a new bidet shower seat which is susceptible of a low cost of manufacture with regard to both materials and labor, and which accordingly is the susceptible of low prices of sale to the consuming public, thereby making such bidet shower seats economically available to the buying public.

Still yet another object of the present invention is to provide a new bidet shower seat which provides in the apparatuses and methods of the prior art some of the advantages thereof, while simultaneously overcoming some of the disadvantages normally associated therewith.

Still another object of the present invention is to provide a new bidet shower seat for washing portions of a human body.

Yet another object of the present invention is to provide a new bidet shower seat which includes a stool upon which an individual can sit, with an interior bowl of the stool including spray nozzles directing water onto a genital region of the user, an extendable spray nozzle mounted to the stool which can be used to selectively shower individual portions of the user, and a support chair positioned over the stool for further supporting the user relative to the stool during a bathing procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a bidet shower seat according to the present invention.

FIG. 2 is a top plan view thereof.

FIG. 7 is a side elevation of the present invention including a support chair.

FIG. 8 is a front elevation view thereof taken from line 8—8 of FIG. 7.

DESCRIPTION OF THE PREFERRED EMBODIMENT

Figure 3:
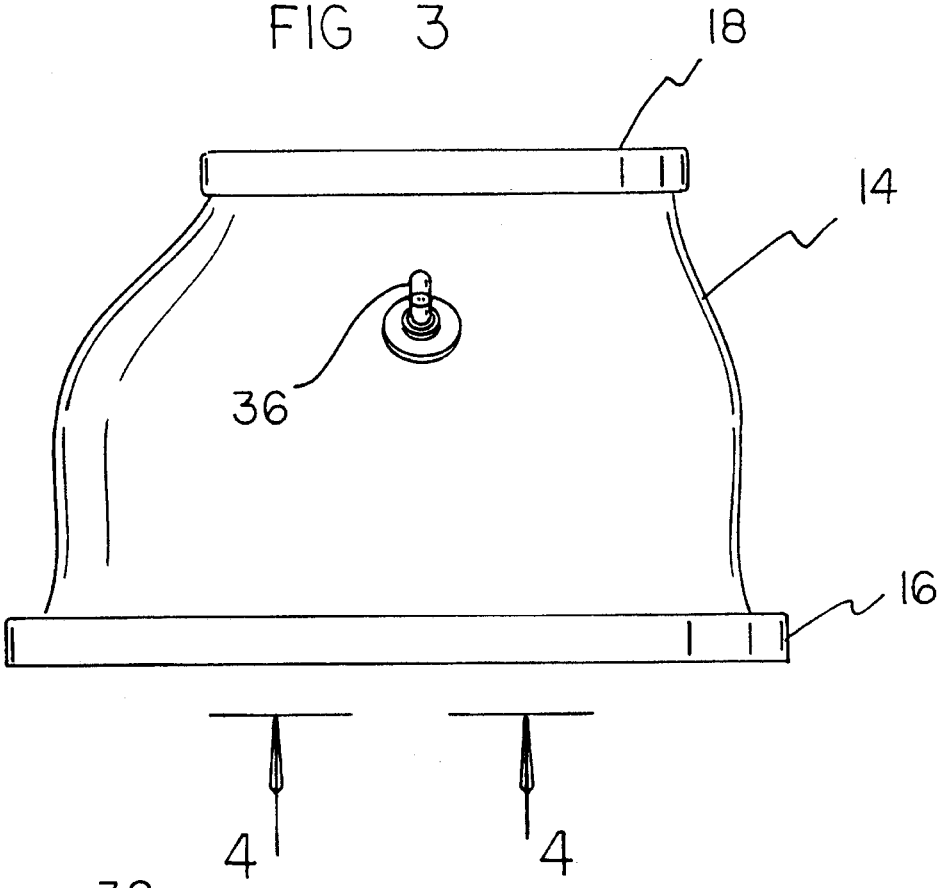
FIG. 3 is side elevation of the invention.

With reference now to the drawings, and in particular to FIGS. 1–8 thereof, a bidet shower seat embodying the principles and concepts of the present invention and generally designated by the reference numeral 10 will be described.

More specifically, it will be noted that the bidet shower seat 10 comprises a stool 12 upon which an individual can sit during use of the device 10. The stool 12 comprises an outer body 14 having a mounting flange 16 extending from a lower end thereof permitting securement of the device 10 within a shower or like enclosure. The outer body 14 is further shaped so as to define an enlarged upper rim 18 upon which an individual can sit. An interior bowl 20 is mounted within the outer body 14 and positioned in contiguous communication with the enlarged upper rim 18 so as to reside beneath a genital area of an individual sitting upon the stool 12. As shown in FIGS. 1 and 2 of the drawings, a plurality of anterior spray nozzles 22 are mounted to an interior surface of the interior bowl 20 proximal to a forward portion thereof. Similarly, a plurality of posterior spray nozzles 24 are mounted to an interior surface of the interior bowl 20 proximal to a rear end thereof. The spray nozzles 22 and 24 are positioned in fluid communication with a water supply conduit 26 having a water valve 28 which can be coupled to a source of pressurized water such that the spray nozzles direct such pressurized water onto the genital region of the user residing upon the stool 12 during use of the device 10. Preferably, the water valve 28 is foot-operated and mounted within a floor of the associated enclosure or shower. As shown in FIG. 2, a drain fitting 30 extends through a central portion of the interior surface of the interior bowl 20 and is coupled to a drain conduit 32 having a drain valve 34 couplable to a waste water drain or sewer. Preferably, the drain valve 34 is also foot-operable such that an individual residing upon the stool 12 can operate both the water valve 28 and the drain valve 34 with a simple depression of the foot.

Figure 4:
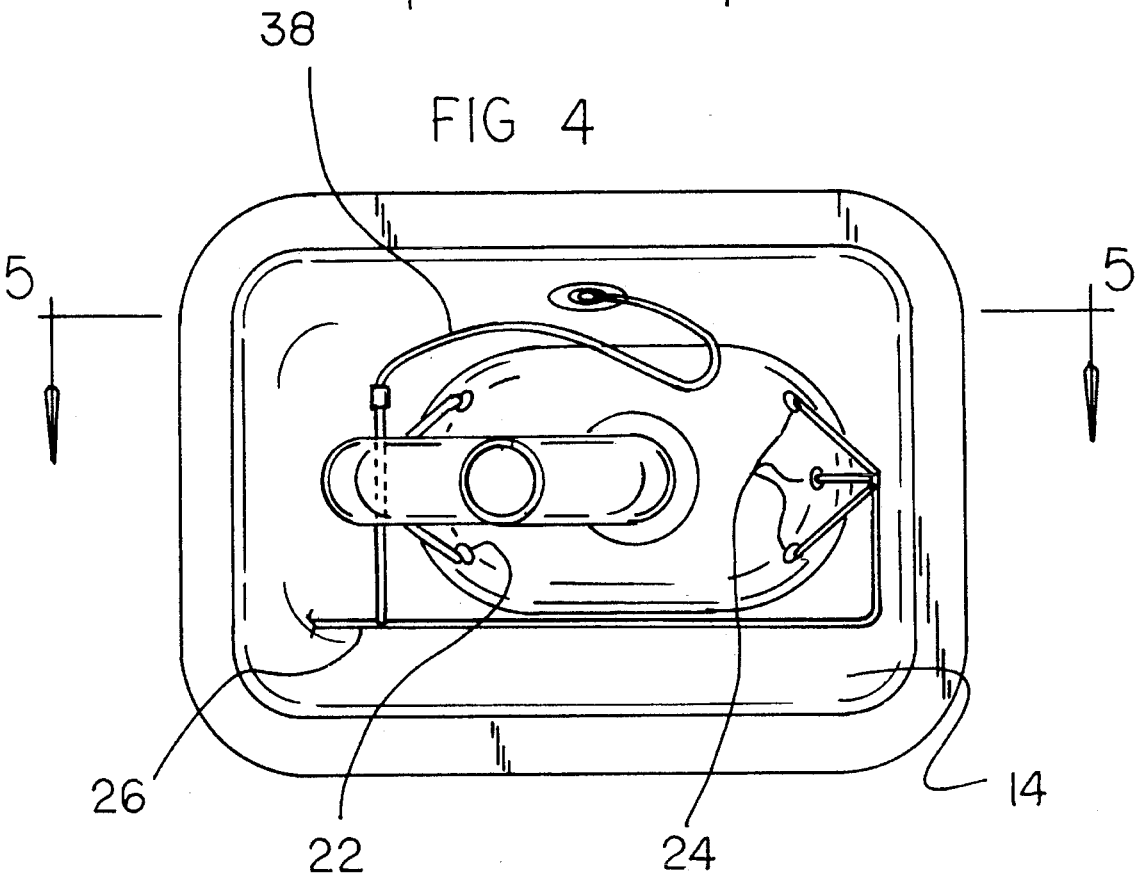
FIG. 4 is a bottom plan view of the invention taken from line 4—4 of FIG. 3.

As shown in FIGS. 1 through 4, an extendable spray nozzle 36 is removably positioned within an aperture extending through a side wall of the outer body 14. The extendable spray nozzle 36 is fluidly coupled to a flexible conduit 38, as shown in FIG. 4 of the drawings, which is positioned in fluid communication with the water supply conduit 26. The extendable spray nozzle 36 includes an unlabeled trigger valve mounted thereon permitting selective dispensing of pressurized water from the water supply conduit 26 through the spray nozzle 36 when the water valve 28 is open. The extendable spray nozzle 36 can thus be removed from the aperture in the outer body 14 with the flexible conduit 38 extending therethrough to be manually manipulated about an individual residing upon the stool 12 within a shower or other enclosure to permit washing or bathing of individual portions of the user. By this structure, an individual residing upon the stool 12 of the device 10 can receive water directed on the genital area, with the individual or other attendant utilizing the extendable spray nozzle 36 to effect washing of various parts of the user's body.

Figure 5:
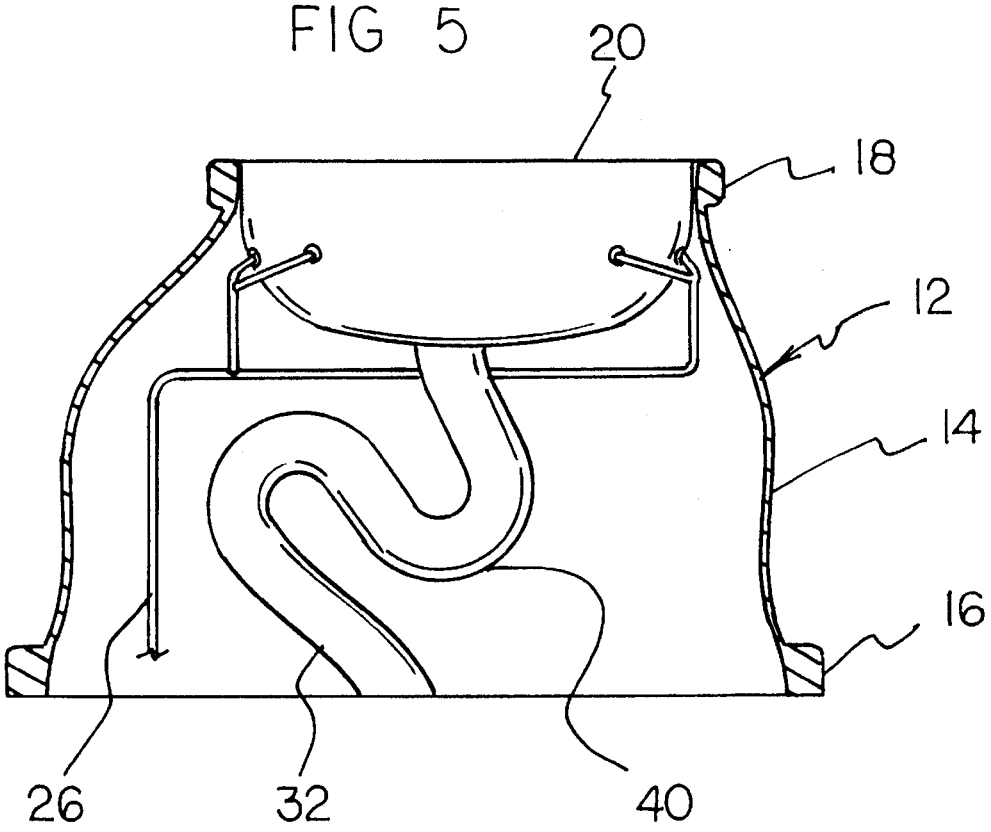
FIG. 5 is a cross sectional view taken along line 5—5 of FIG. 4.
Figure 6:
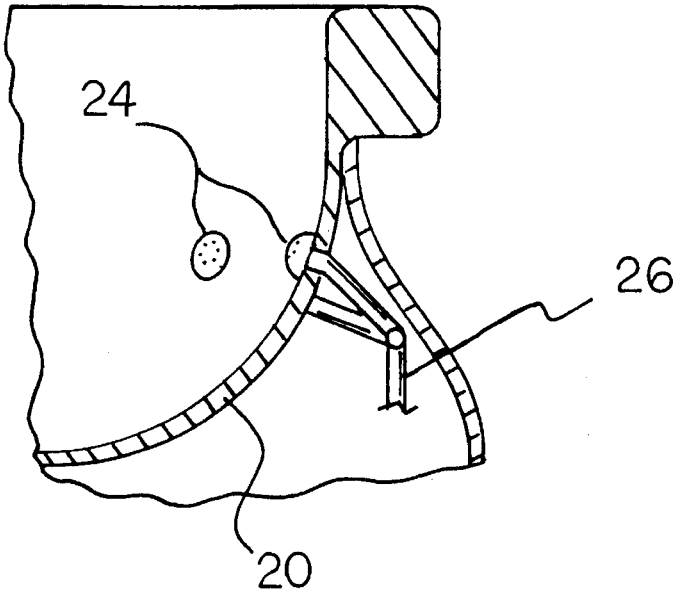
FIG. 6 is an enlarged cross sectional view of a portion of the present invention.

As shown in FIG. 5, the drain conduit 32 is preferably shaped so as to define an S-shaped water trap 40 precluding an entrance of air or gas from an associated sewer conduit when the drain conduit 32 is coupled thereto. As shown in FIG. 6 for the posterior spray nozzles 24, each of the spray nozzles preferably comprises a substantially hemi-spherical member having a plurality of spray holes directed therethrough and mounted to an interior surface of the interior bowl 20. The water conduit 26, within the outer body 14, splits into a plurality of conduits each individually communicating with an individual one of the spray nozzles 22–24.

Referring now to FIG. 7 and 8, it can be shown that the present invention 10 may further comprise a support chair 42 having a chair bottom 44 supported in a substantially spaced and parallel orientation relative to a ground surface by a plurality of chair legs 46 projecting therefrom. The chair bottom 44 is shaped so as to define a central aperture 48 directed therethrough which can be positioned circumferentially about the enlarged upper rim 18 of the stool 12. A chair back 50 projects substantially orthogonally from the chair bottom 44 and operates to support a rear or posterior portion of an individual utilizing the device 10. As shown in FIG. 8, lateral handles 52 are preferably secured to opposed sides of the chair back 50 to provide a surface upon which an individual utilizing the device 10 can grasp to maintain balance within the support chair 42. By this structure, an individual utilizing the device 10 is afforded support along both a back and bottom of the human body. If desired, the support chain 42 may further comprise arm rests extending along opposed sides of the chair bottom 44 in a conventional manner.

In use, the bidet shower seat 10 according to the present invention can be easily utilized for washing portions of the human body. The present invention 10 is particularly useful in the care in the elderly patients or others lacking proper motor skills necessary for self-care.

As to further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bidet shower seat comprising:

a stool upon which an individual can sit, the stool including an outer body having an enlarged upper rim;

an interior bowl mounted within the outer body and positioned in contiguous communication with the enlarged upper rim so as to reside beneath a genital area of an individual when sitting on the stool;

a plurality of spray nozzles mounted within the interior bowl for directing water from a pressurized water supply source onto a genital area of a user, the nozzles further comprising a plurality of anterior spray nozzles mounted to an interior surface of the interior bowl proximal to a forward portion thereof, and a plurality of posterior spray nozzles mounted to an interior surface of the interior bowl proximal to a rear portion thereof, each of the spray nozzles comprises a substantially hemi-spherical member having a plurality of spray holes directed therethrough and mounted to an interior surface of the interior bowl, the hemi-spherical members each being fluidly coupled to a water conduit within the outer body;

an extendable spray nozzle removably positioned within an aperture extending through a side wall of the outer body; and a flexible conduit fluidly coupled to the extendable spray nozzle, the flexible conduit being in fluid communication with the plurality of spray nozzles, wherein the extendable spray nozzle can be removed from the aperture in the outer body with the flexible conduit extending therethrough to be manually manipulated about a user residing upon the stool to permit washing of individual portions of the user;

a water supply conduit having a water valve which can be coupled to a source of pressurized water, the water supply conduit being positioned in fluid communication with the spray nozzles, the water valve being a foot operated valve mountable within a floor of a shower;

a drain fitting extending through a central portion of an interior surface of the interior bowl, and a drain conduit coupled to the drain fitting, a drain valve coupled to the drain conduit, the drain valve being foot operated, the drain conduit being shaped so as to define an S-shaped water trap precluding an entrance of gas from a sewer conduit when the drain conduit is coupled thereto;

a support chair having a chair bottom having a plurality of chair legs projecting therefrom, the chair bottom being shaped so as to define a central aperture directed therethrough positioned circumferentially about the enlarged upper rim of the stool, the support chair having a chair back projecting substantially orthogonally from the chair bottom, the support chair having lateral handles secured to opposed sides of the chair back.

* * * * *